US010297102B2

(12) United States Patent
Lim et al.

(10) Patent No.: US 10,297,102 B2
(45) Date of Patent: May 21, 2019

(54) GAME VENDING MACHINE

(71) Applicant: KOMUSE Co., Ltd., Paju-si, Gyeonggi-do (KR)

(72) Inventors: Gyo In Lim, Goyang-si (KR); Seong Wook Jeong, Goyang-si (KR); Nam Ho Kang, Gimpo-si (KR); Seong Ho Park, Goyang-si (KR); Young Tae Kim, Paju-si (KR)

(73) Assignee: KOMUSE CO., LTD., Paju-si, Gyeonggi-do (KR)

( * ) Notice: Subject to any disclaimer, the term of this patent is extended or adjusted under 35 U.S.C. 154(b) by 0 days.

(21) Appl. No.: 15/490,126

(22) Filed: Apr. 18, 2017

(65) Prior Publication Data

US 2017/0365125 A1 Dec. 21, 2017

(30) Foreign Application Priority Data

Jun. 15, 2016 (KR) ..... 10-2016-0074383

(51) Int. Cl.
*G07F 17/32* (2006.01)

(52) U.S. Cl.
CPC ..... *G07F 17/32* (2013.01)

(58) Field of Classification Search
CPC . A63F 2011/0016; A63F 5/04; G07F 17/3297
See application file for complete search history.

(56) References Cited

U.S. PATENT DOCUMENTS 2,799,500 A * 7/1957 Zekowski ..... A63F 5/04
273/141 A

FOREIGN PATENT DOCUMENTS

KR 20-0245379 Y1 10/2001

* cited by examiner

*Primary Examiner* — Gene O Crawford
*Assistant Examiner* — Kevin L Randall, Jr.
(74) *Attorney, Agent, or Firm* — Rabin & Berdo, P.C.

(57) ABSTRACT

Provided is a game vending machine. The game vending machine includes a vertical guide unit, which are formed on an inner wall of a cover frame, in which a lifting block is coupled to a target unit, which is formed on a front surface of the lifting block, a driving unit is coupled to a back surface of the cover frame, a rotary plate is rotatably provided, prize holders are formed inside the housing, and the target block is configured to enter the target groove, wherein, the first sensor is operated by the first sensing frame, and a prize accommodated therein is moved downward.

9 Claims, 13 Drawing Sheets

GAME VENDING MACHINE

CROSS-REFERENCE TO RELATED APPLICATION

This application claims priority to and the benefit of Korean Patent Application No. 10-2016-0074383, filed on Jun. 15, 2016, the disclosure of which is incorporated herein by reference in its entirety.

BACKGROUND

1. Field of the Invention

The present invention relates to a game vending machine, and more particularly, to a game vending machine including a target unit which moves upward and downward along a vertical guide unit, in which a target block of the target unit enters a target groove of a rotary plate and a first sensor is operated by a first sensing frame so that a prize in a prize holder corresponding to the target groove is moved downward into a housing so that the prize can be obtained.

2. Discussion of Related Art

Generally, a game vending machine is an apparatus for obtaining a designated prize according to a result of winning or losing a game, and includes a prize dispenser for obtaining an even greater accomplishment in playing games.

In this case, in such a game vending machine, a result of winning or losing a game is determined according to an operational ability of a user, and thus a user who enjoys the game may obtain a sense of accomplishment.

In Patent Document 1, a conventional prize discharging apparatus is disclosed. When referring to this document, the prize discharging apparatus includes a hollow body, a pair of belt frames protruding from a front surface of the body so as to oppose each other, a driving gear rotatably provided inside the body, a belt pulley having one end connected to the driving gear and the other end connected to an end of the belt frame, and configured to be circulated, a plurality of grooves for hanging prizes formed to be spaced a predetermined interval apart from each other along an outer surface of the belt pulley and hang and fix prizes, and a switch provided below the driving gear and pressed and operated by the driving gear.

Here, a game proceeds after a user inserts a coin into the prize discharging apparatus. In this case, when the user wins the game, the driving gear is rotated by a predetermined angle to circulate the belt pulley.

A prize hung in the grooves for hanging prizes is moved forward by the belt pulley and is then moved downward and discharged by the belt pulley, which is circulated at the end of the belt frame.

In this case, the driving gear includes protrusions which are formed on opposite outer surfaces thereof to press and operate the switch. At the same time that the protrusion presses the switch, the operation of the belt pulley is stopped and the downward movement of the prize hung in the grooves for hanging prizes is prevented.

However, in the above-described Patent Document 1, there is a problem in that a driving force of the belt pulley is reduced due to an excessive weight of the prize hung in the grooves for hanging prizes, the driving gear engaged with the belt pulley idles due to the weight of the prize, and thus a frictional force is generated between the belt pulley and the driving gear, the belt pulley or teeth of the driving gear are damaged by the frictional force, the belt frame sags due to the weight of the prize hung at the end of the belt frame, the prize is easily separated from the grooves for hanging prizes due to the sag of the belt frame, and there is no choice of prizes since prizes located behind the separated prize are sequentially discharged after the prize, which is exposed forward, is discharged, and accordingly, reliability of the apparatus is reduced.

DOCUMENT OF RELATED ART

Patent Document (Patent Document 1) KR 20-0245379 Y1

SUMMARY OF THE INVENTION

The present invention is directed to a game vending machine including a vertical guide unit having a guide rail and a first sensor which are formed on an inner wall of a cover frame, in which a lifting block, which is slidably coupled to the guide rail of the vertical guide unit, is coupled to a target unit having a target block and a first sensing frame, which is formed on a front surface of the lifting block, a driving unit which moves the target unit upward and downward is coupled to a back surface of the cover frame, a rotary plate having a plurality of target grooves is rotatably provided on an upper portion of the front surface of the vertical guide unit, prize holders are formed inside the housing to be adjacent to each other based on the vertical guide unit, and the target block enters the target groove, wherein when the target block enters the target groove, the first sensor is operated by the first sensing frame, and a prize accommodated therein is moved downward while the prize holder corresponding to the target grooves is moved forward.

According to an aspect of the present invention, there is provided a game vending machine including a hollow housing including an open front surface and a prize outlet path formed on a lower portion thereof to guide a discharge of a prize, an opening and closing door rotatably coupled to the front surface of the housing, configured to open and close the front surface of the housing, and having a coin input slot and an outlet port through which the prize is discharged, wherein the coin input slot and the outlet port are formed on a front surface of the opening and closing door, a vertical guide unit including a hollow cover frame having an open front surface and attached to a back surface thereof, a through hole corresponding to the cover frame and formed on the front surface thereof, a guide rail corresponding to the through hole and formed on an inner wall of the cover frame, and a first sensor configured to output a signal and formed at an upper portion of an inner wall thereof, wherein the vertical guide unit is fixed to be in close contact with an inner wall of the housing, a target unit including a lifting block slidably coupled to the guide rail, a target block exposed to an outside of the through hole, and a first sensing frame configured to be moved upward and downward by the lifting block to operate the first sensor, wherein the target block and the first sensing frame are formed on a front surface of the lifting block, a driving unit provided on a back surface of the cover frame to be moved upward and downward and configured to move the target unit upward and downward, a rotary plate rotatably provided on an upper portion of a front surface of the vertical guide unit and having a plurality of target grooves formed on a front surface thereof, wherein the plurality of target grooves are formed to be annularly spaced a predetermined interval apart from each other to allow the target block of the target unit to enter therein, and prize holders provided inside the housing to be adjacent to each other based on the vertical guide unit, moved in the forward and backward directions, and configured to move prizes accommodated therein downward.

The cover frame of the vertical guide unit may further include a second sensor configured to sense the first sensing frame of the lifting block, which is moved downward, and to block the lifting block from being moved a predetermined distance or more downward, wherein the second sensor is formed on a lower portion of the inner wall of the cover frame.

A third sensor may be formed on the back surface of the cover frame to sense whether the target block of the target unit collides with a periphery of the target groove of the rotary plate, control the driving unit, and move the target unit downward, and a second sensing frame may be further formed on one side surface of the driving unit to be separated from the third sensor and to operate the third sensor.

The target unit may include a rack gear formed on a back surface of the lifting block in a longitudinal direction thereof, the driving unit may include a motor therein, and a pinion gear, which is connected to the motor, has one side surface engaged with the rack gear, and moves the rack gear upward and downward, may be formed on an outer surface of the driving unit.

The driving unit may include a pair of support plates fixed to upper and lower ends of the back surface of the cover frame and including a pair of guide rods which protrude in directions toward each other, a lift housing provided between the support plates and including the motor formed therein and the pinion gear connected to the motor formed on one side surface thereof, and an elastic spring provided between one of the support plates, which is provided on a lower portion, and the lift housing and configured to press the lifting housing, which is moved downward, upward.

The prize holder may include a support unit fixedly provided inside the housing, a hollow moving unit having a shape in which upper and lower portions are open, provided inside the support unit so as to be moved forward and backward, and configured to push a prize placed on the support unit, and a driving device provided on a back surface of the moving unit and configured to move the moving unit forward and backward.

A front surface of the moving unit may be made of a transparent material so that the prize placed on the support unit may be seen from the outside.

The support unit may include a through hole formed on an upper surface thereof in a longitudinal direction thereof, a rack gear may be formed in the through hole, the driving device may include a motor therein and a pinion gear connected to the motor, and an outer surface of the pinion gear may be engaged with the rack gear.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present invention will be described in detail with reference to the accompanying drawings.

Figure 1:
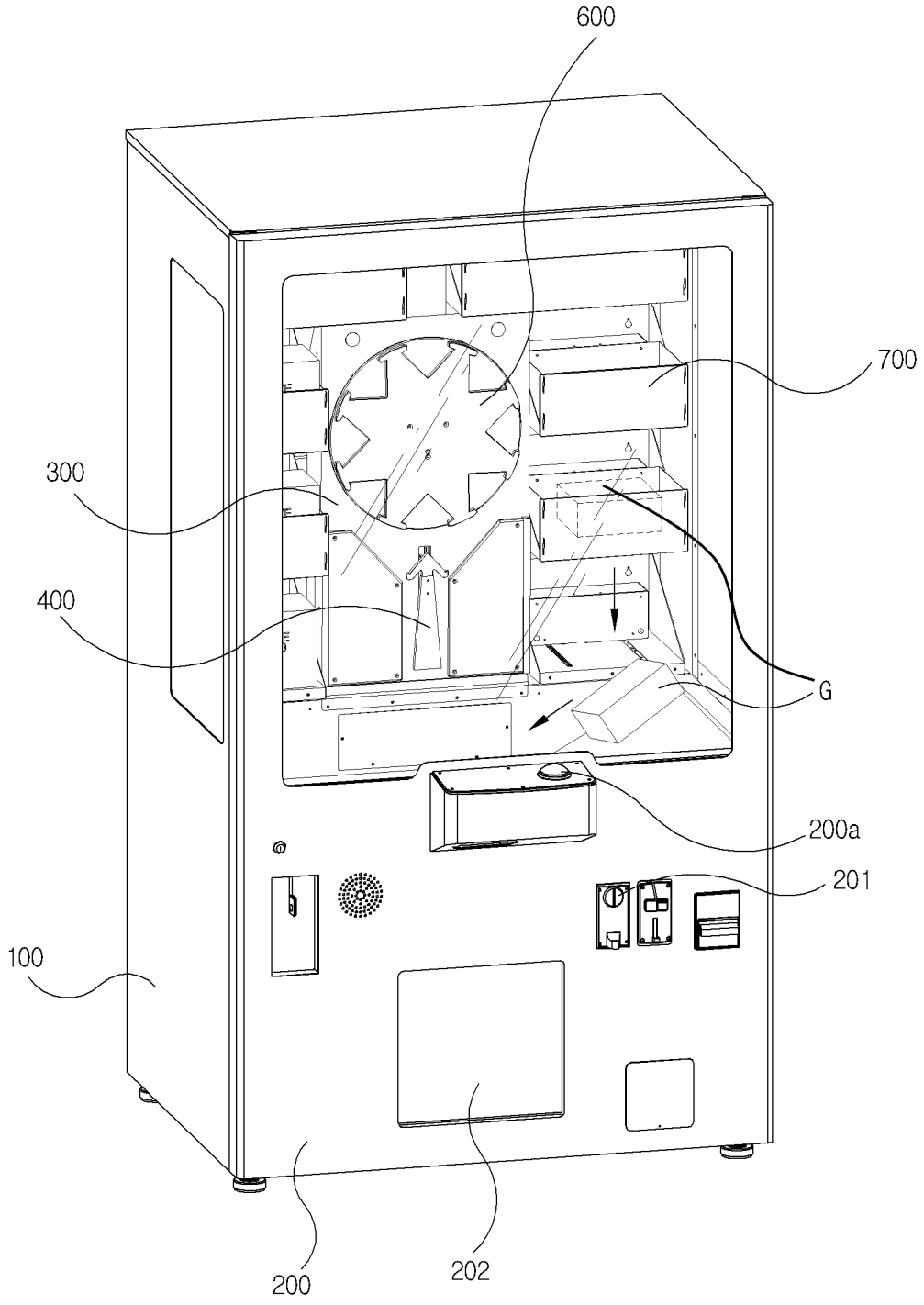
FIG. 1 is a perspective view illustrating a game vending machine according to the present invention.
Figure 2:
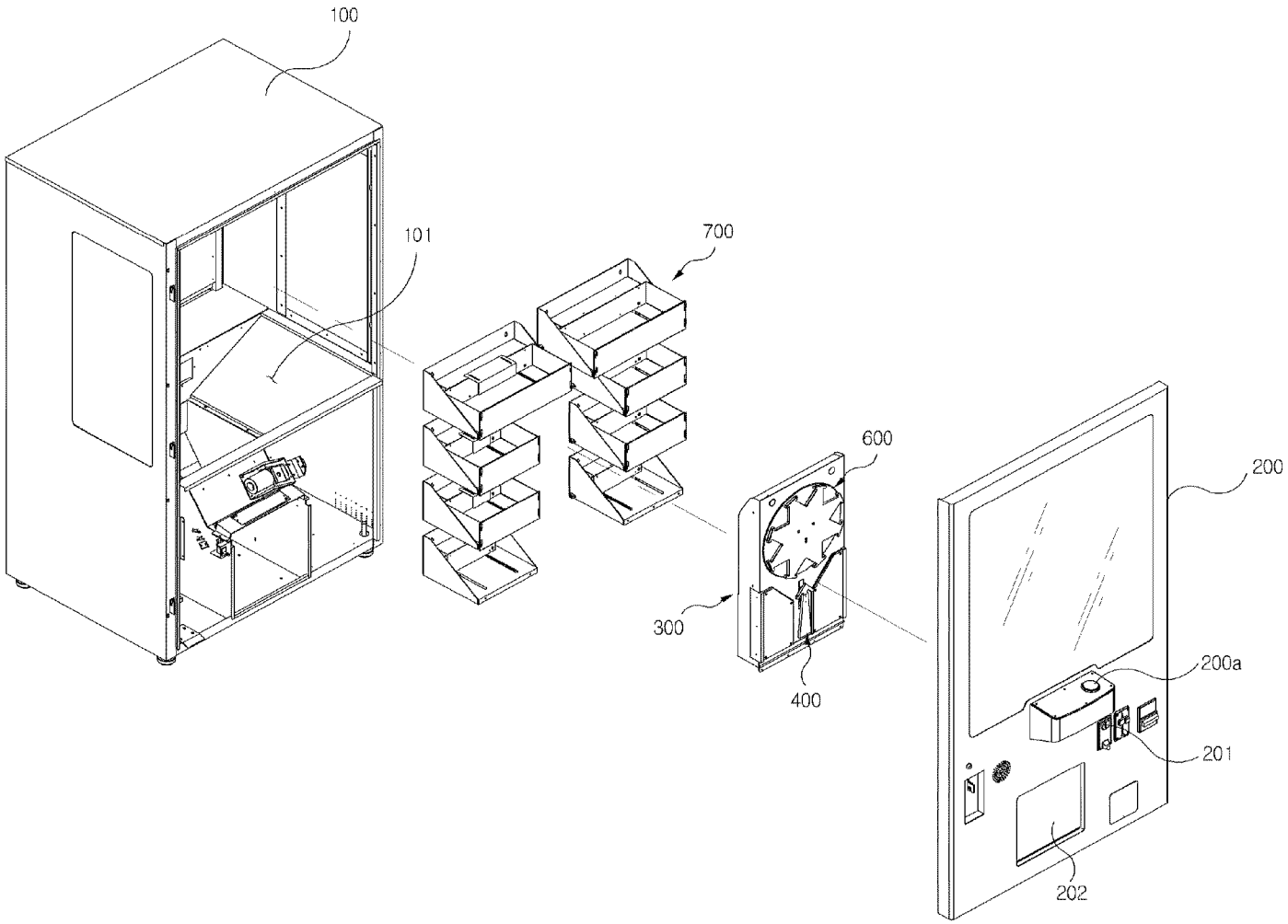
FIG. 2 is an exploded perspective view of the game vending machine of FIG. 1.
Figure 3:
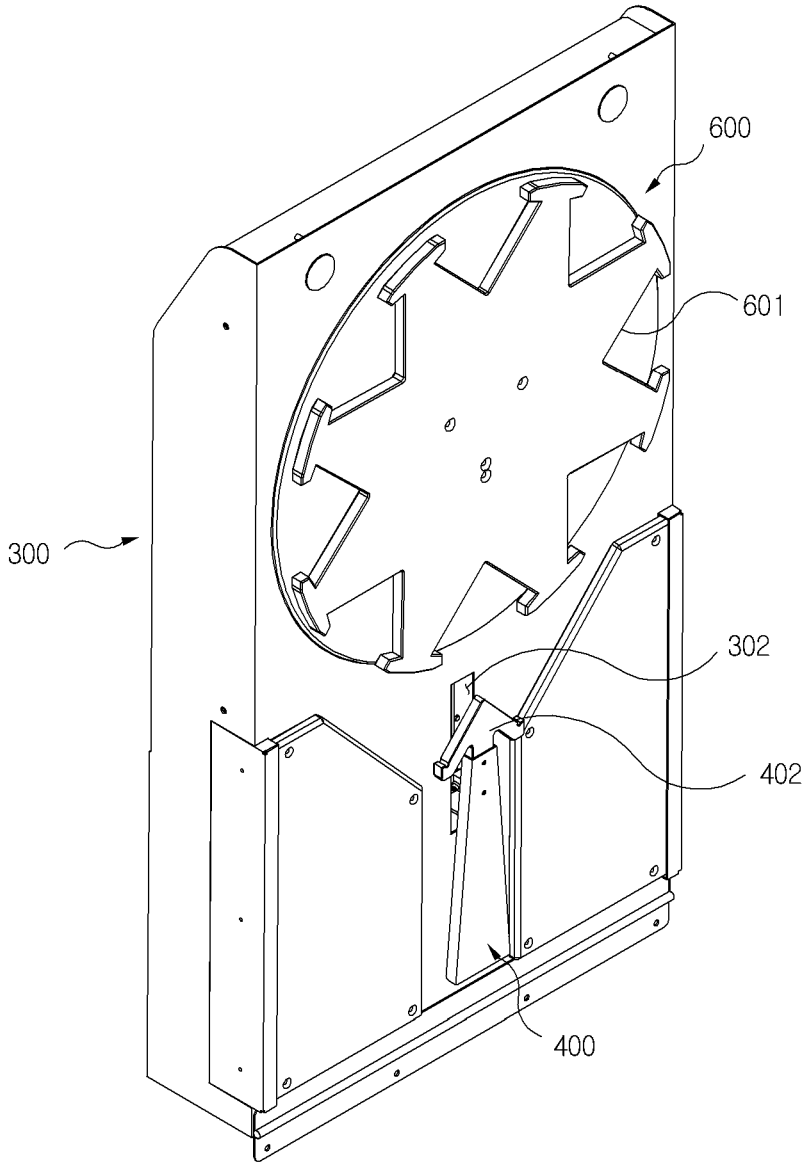
FIG. 3 is a perspective view illustrating a main component of the game vending machine according to the present invention.
Figure 4:
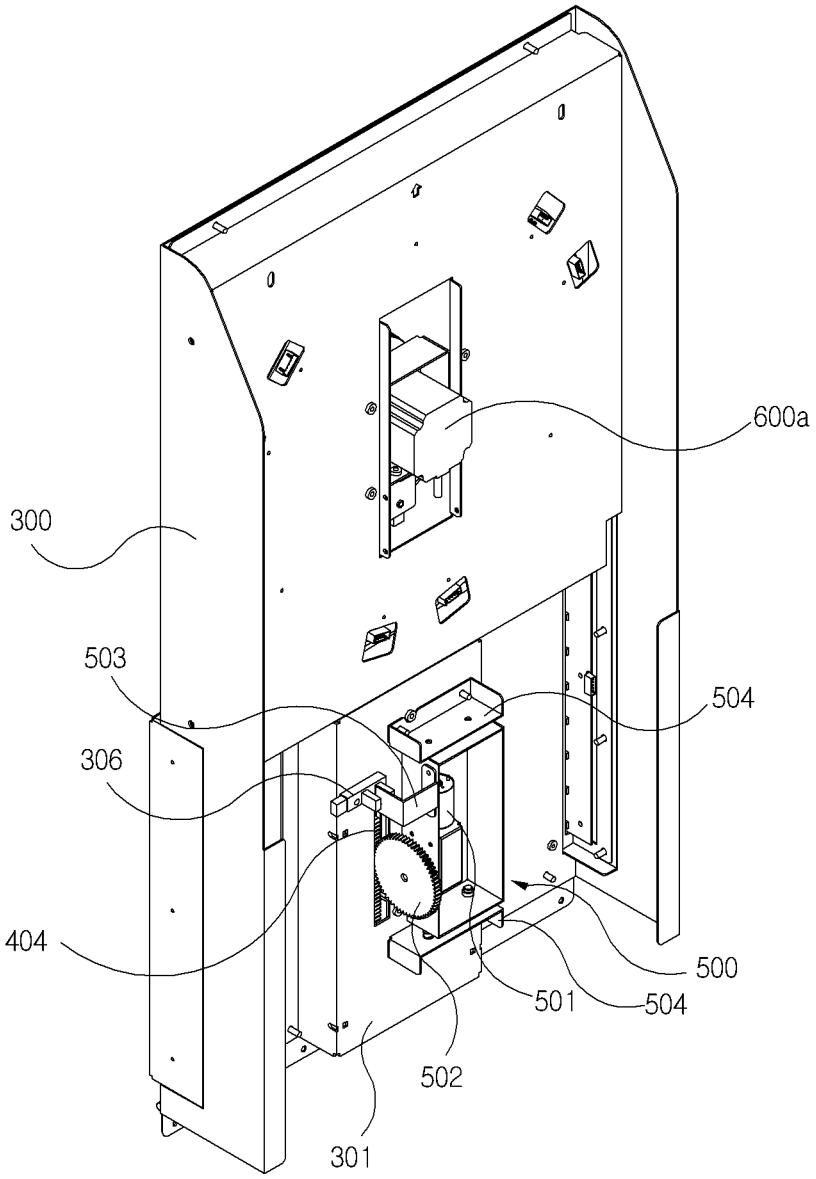
FIG. 4 is a rear perspective view of the main component of the game vending machine of FIG. 3.
Figure 5:
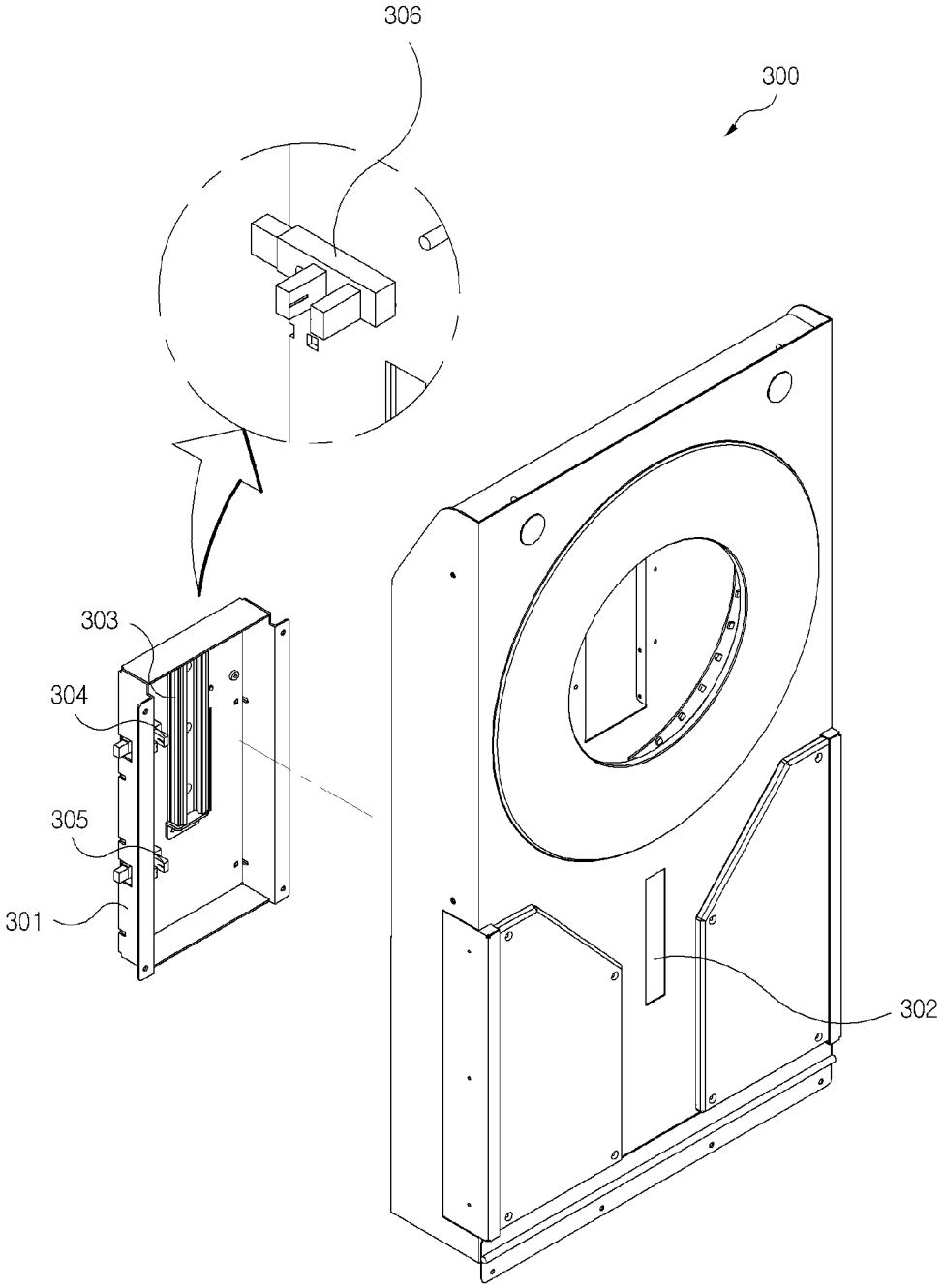
FIG. 5 is a perspective view illustrating a vertical guide unit of the game vending machine according to the present invention.
Figure 6:
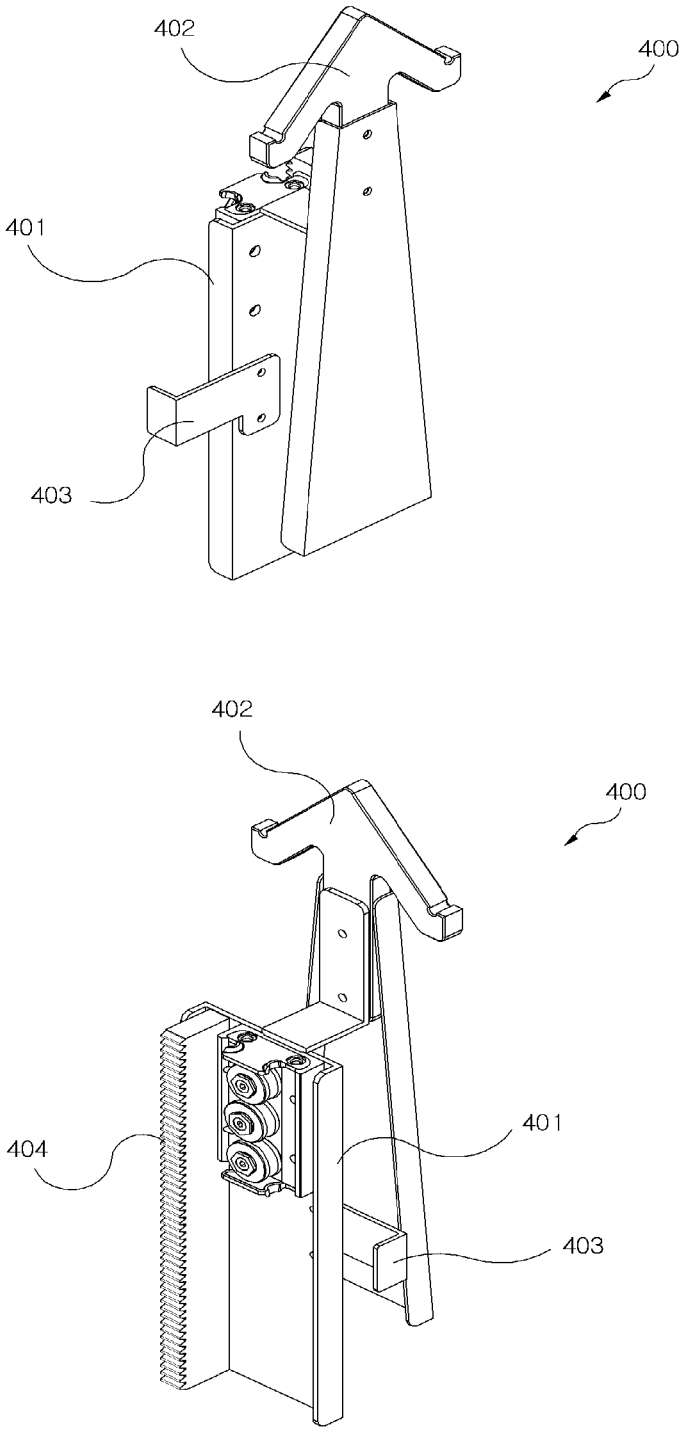
FIG. 6 is a perspective view illustrating a target unit of the game vending machine according to the present invention.
Figure 7:
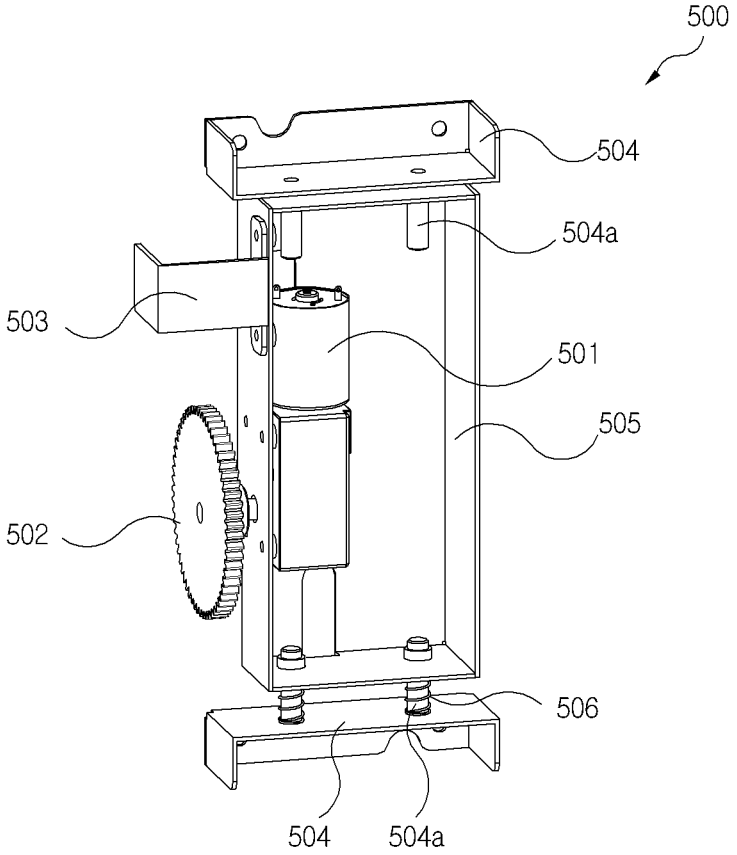
FIG. 7 is a perspective view illustrating a driving unit of the game vending machine according to the present invention.
Figure 8:
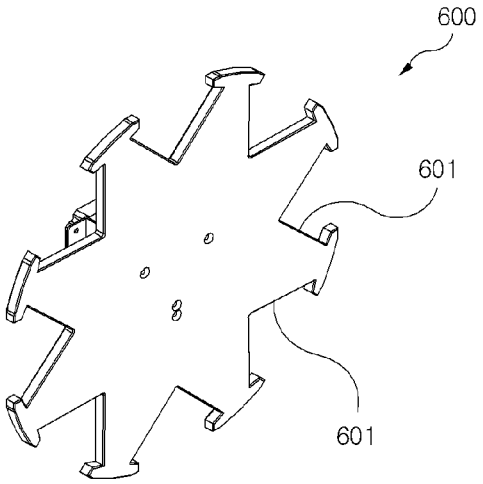
FIG. 8 is a perspective view illustrating a rotary plate of the game vending machine according to the present invention.
Figure 8:
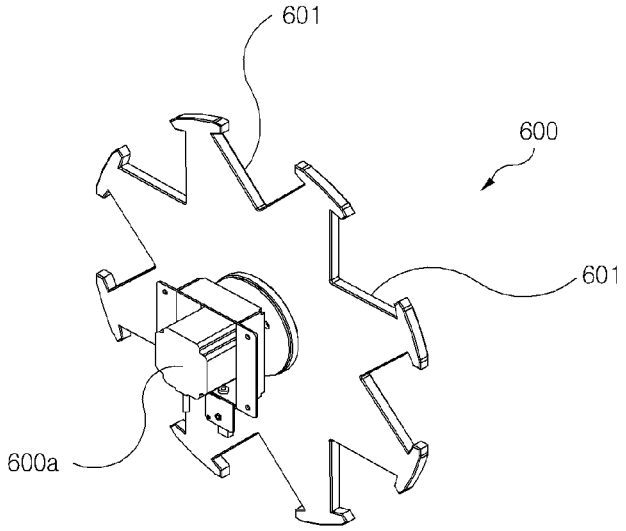
Figure 9:
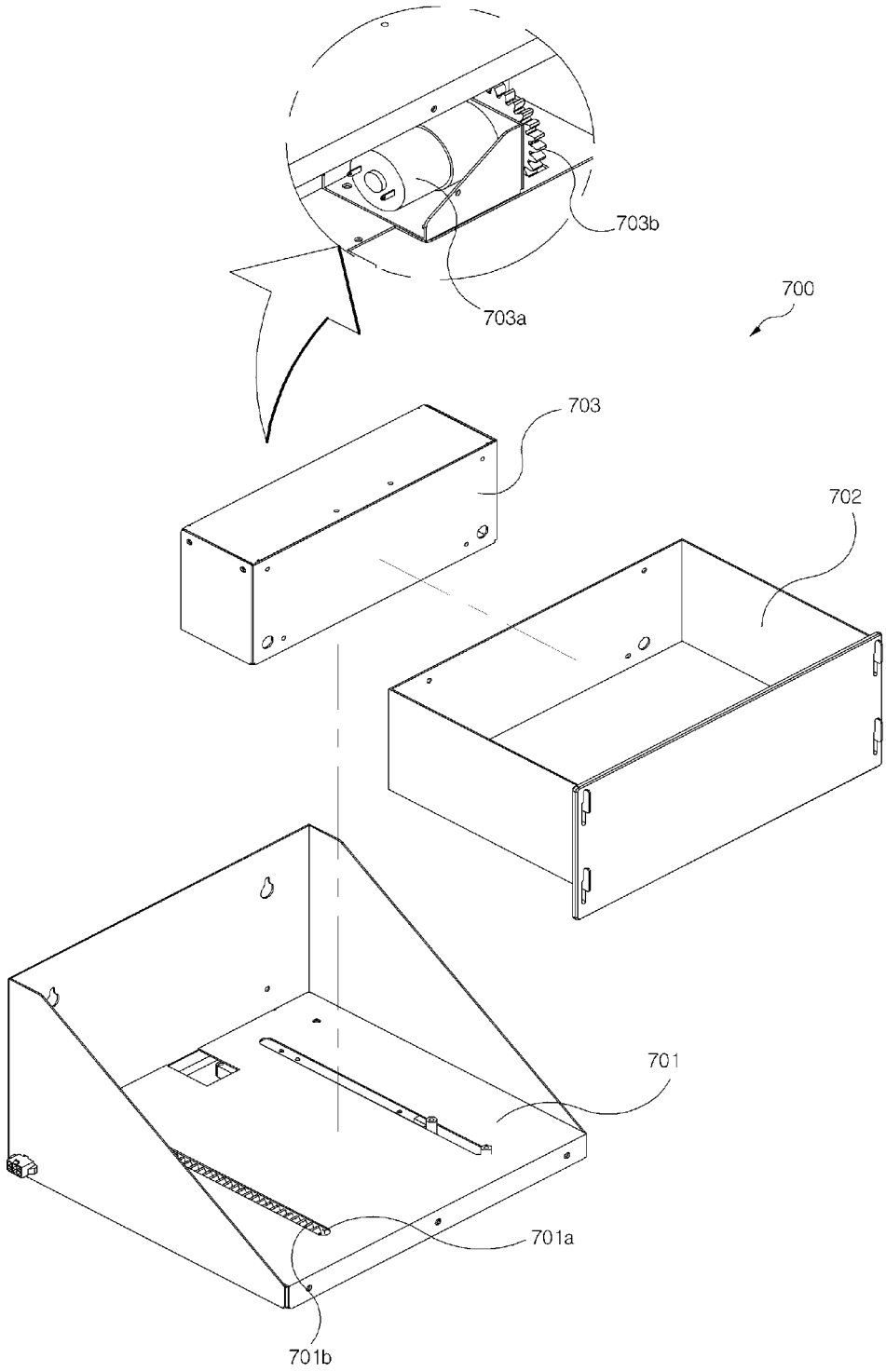
FIG. 9 is a perspective view illustrating a prize holder of the game vending machine according to the present invention.
Figure 10:
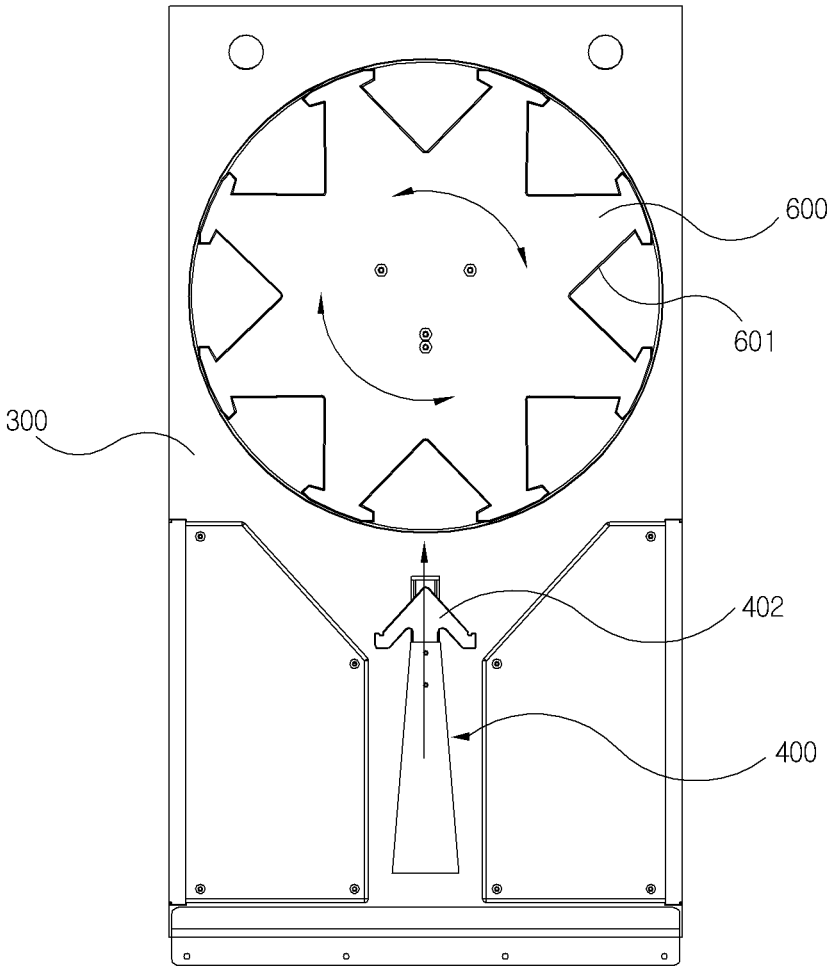
FIGS. 10 to 13 are views illustrating operating states of the game vending machine according to the present invention.
Figure 11:
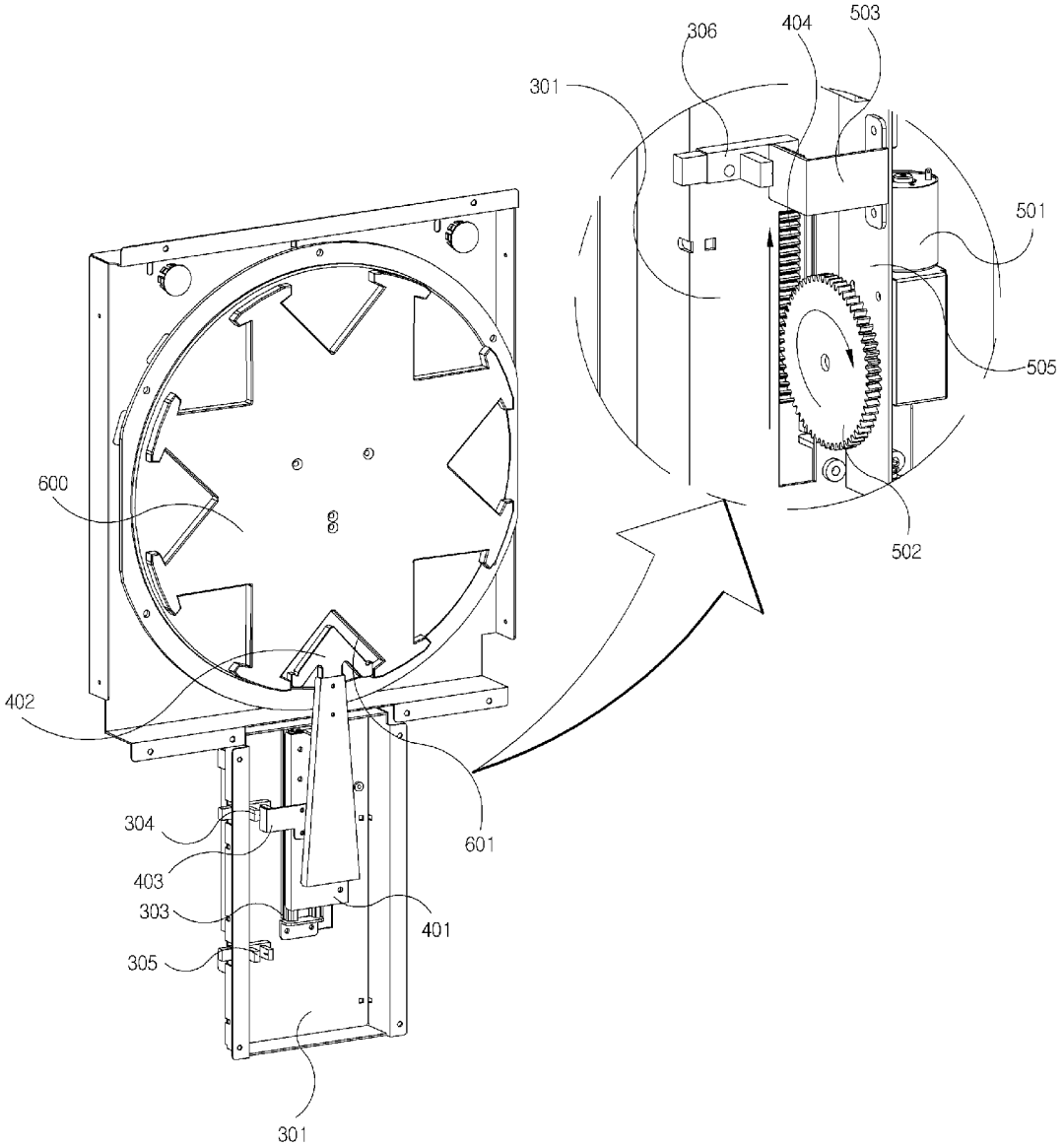
Figure 12:
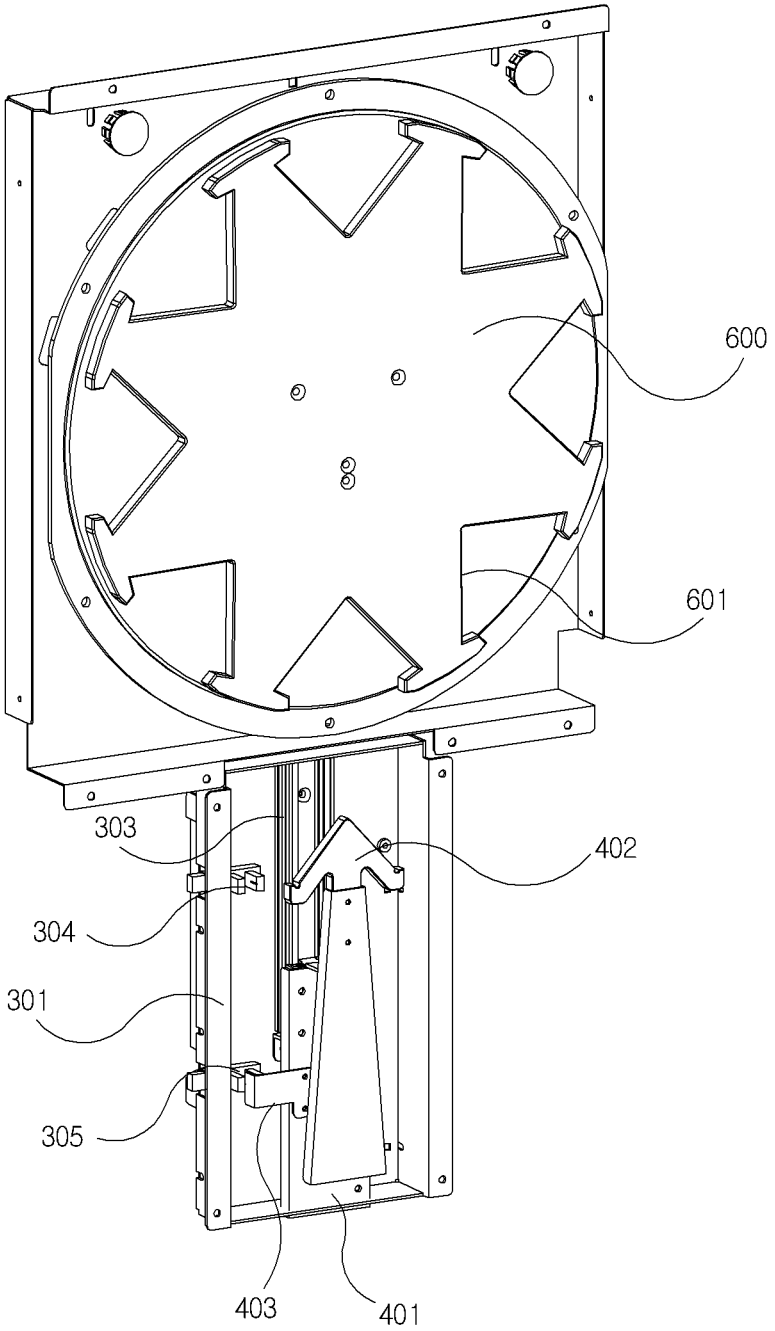
Figure 13:
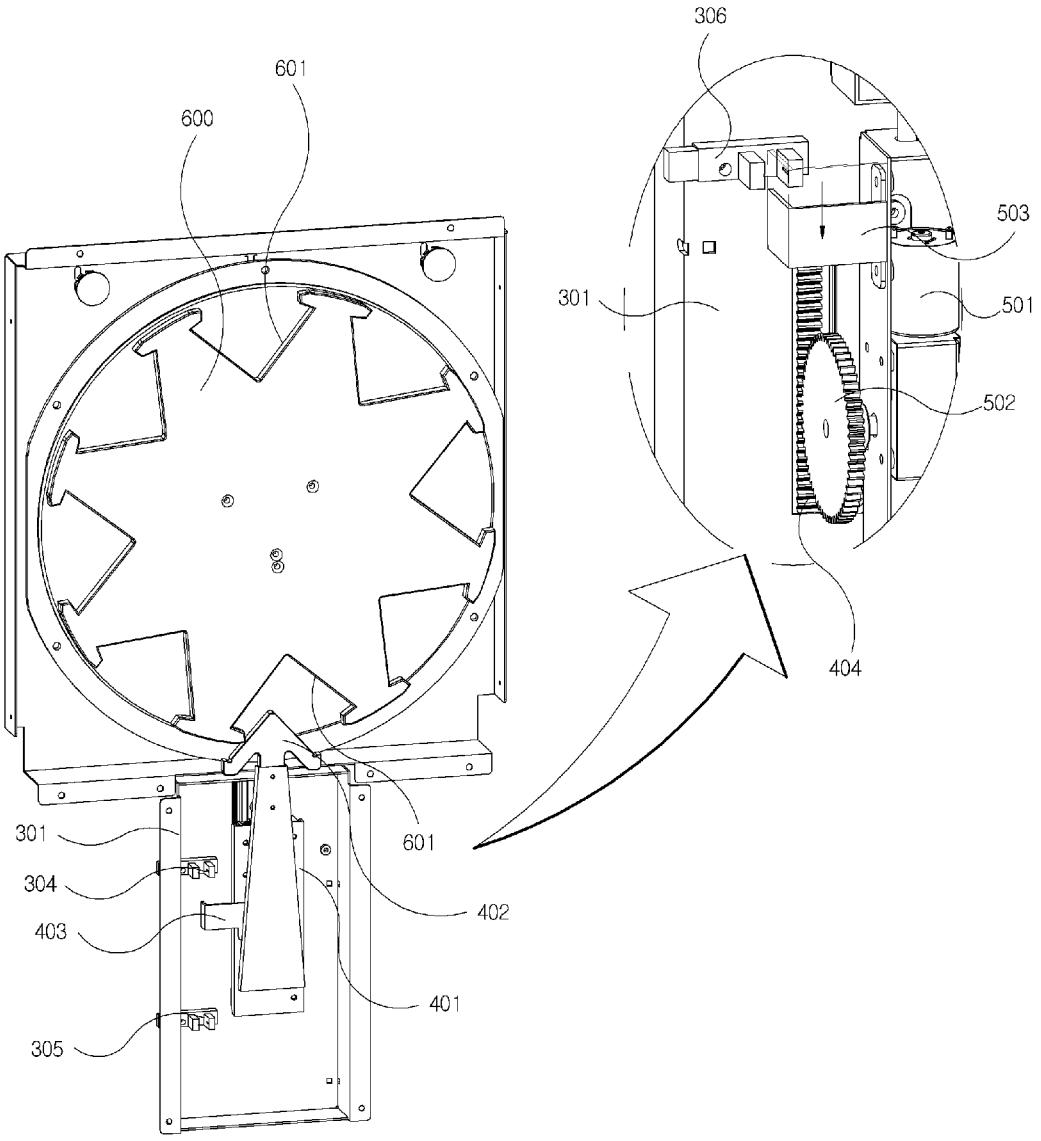

Referring to FIGS. 1 to 13, a hollow housing 100 has an open front surface, and a prize outlet path 101 is formed at a lower portion of the housing 100 to guide a discharge of a prize.

The housing 100 includes a vertical guide unit 300, a target unit 400, a driving unit 500, a rotary plate 600, and prize holders 700 therein.

The prize outlet path 101 is preferably formed to have a downwardly inclined structure in which an upper portion is wide and a lower portion is narrow.

An opening and closing door 200 is rotatably coupled to a front surface of the housing 100 to open and close the front surface of the housing 100, and includes a coin input slot 201 and an outlet port 202 through which a prize is discharged, which are formed on a front surface thereof.

A transparent window (not illustrated) through which an interior of the housing 100 may be seen is formed at an upper portion of the front surface of the opening and closing door 200.

The opening and closing door 200 is preferably coupled to one end of the housing 100 with hinges.

A button 200*a* is formed on the front surface of the opening and closing door 200 to stop rotation of the rotary plate 600 and move a lifting block 401 of the target unit 400 upward and downward.

The vertical guide unit 300 includes a hollow cover frame 301 having an open front surface and attached to a back surface thereof, a through hole 302 corresponding to the cover frame 301 and formed on a front surface thereof, a guide rail 303 corresponding to the through hole 302 and formed on an inner wall of the cover frame 301, and a first sensor 304 which outputs a signal and is formed at an upper portion of an inner wall thereof. The vertical guide unit 300 is fixed to be in close contact with an inner wall of the housing 100.

The cover frame 301 covers the guide rail 303 and the first sensor 304 to prevent the guide rail 303 and the first sensor 304 from being exposed behind the vertical guide unit 300.

The guide rail 303 guides the lifting block 401 of the target unit 400 to move upward and downward in a vertical direction.

The lifting block 401 of the target unit 400 passes through the through hole 302 to be slidably coupled to the guide rail 303.

The first sensor 304 is operated by a first sensing frame 403 of the target unit 400 to operate one prize holder 700 selected from the plurality of prize holders 700.

The first sensor 304 simultaneously outputs a signal to any one of the plurality of prize holders 700 according to an angle of the rotary plate 600 and controls a pinion gear 502 to change a rotation direction of the pinion gear 502.

The cover frame 301 of the vertical guide unit 300 further includes a second sensor 305 which senses the first sensing frame 403 of the lifting block 401 which is moved downward, and prevents the lifting block 401 from being moved a predetermined distance or more downward, wherein the second sensor 305 is formed on a lower portion of the inner wall of the cover frame 301.

The second sensor 305 operates at a time point at which the first sensing frame 403 approaches thereto and stops the operation of the pinion gear 502 of the driving unit 500.

A third sensor 306 is formed on a back surface of the cover frame 301 to sense whether a target block 402 of the target unit 400 collides with a periphery of the target groove 601 of the rotary plate 600, control the driving unit 500, and move the target unit 400 downward.

The third sensor 306 operates at a time at which a second sensing frame 503, which is in close proximity thereto, moves away therefrom.

The target unit 400 includes the lifting block 401 which is slidably coupled to the guide rail 303. The target block 402, which is exposed to the outside of the through hole 302, and the first sensing frame 403, which is moved upward and downward by the lifting block 401 to operate the first sensor 304, are formed on a front surface of the lifting block 401.

The lifting block 401 is guided to the guide rail 303 to move the target unit 400 upward and downward.

The target block 402 is moved upward and downward by the lifting block 401 and enters the target groove 601 of the rotary plate 600.

An upper end of the target block 402 is preferably formed to have an arrow shape.

The target unit 400 includes a rack gear 404 formed on a back surface of the lifting block 401 in a longitudinal direction thereof.

The rack gear 404 is engaged with the pinion gear 502 of the driving unit 500 and is moved upward and downward by rotary power of the pinion gear 502, which is rotated in forward and reverse directions.

The driving unit 500 is provided on the back surface of the cover frame 301 so as to be upwardly and downwardly movable, and moves the target unit 400 upward and downward.

The driving unit 500 includes a motor 501 therein. The pinion gear 502, which is connected to the motor 501, has an outer surface engaged with the rack gear 404, and moves the rack gear 404 upward and downward, is formed on one side surface of the driving unit 500.

The pinion gear 502 rotated in the forward or reverse direction by the motor 501 to move the rack gear 404 engaged therewith upward or downward.

The pinion gear 502 is rotated by receiving a signal of the button 200*a* of the opening and closing door 200 and moves the rack gear 404 upward. The pinion gear 502 is rotated in the reverse direction by receiving a signal of the first sensor 304 or the third sensor 306 and moves the rack gear 404 downward.

The second sensing frame 503 is also formed on the one side surface of the driving unit 500 to be separated from the third sensor 306 and to operate the third sensor 306.

The second sensing frame 503 is maintained in a state of being in close proximity to the third sensor 306, and is separated from the third sensor 306 to operate the third sensor 306.

The second sensing frame 503 is preferably formed on one side surface of a lift housing 505 of the driving unit 500.

The driving unit 500 includes a pair of support plates 504, the lift housing 505, and elastic springs 506. The pair of support plates 504 are fixed to upper and lower ends of the back surface of the cover frame 301 and have a pair of guide rods 504*a* which protrude in a direction toward each other. The lift housing 505 is provided between the support plates 504 and has the motor 501 formed therein and the pinion gear 502 connected to the motor 501, wherein the pinion gear 502 is formed on one side surface of the lift housing 505. The elastic springs 506 are provided between one of the support plates 504, which is provided on a lower portion, and the lift housing 505, and press the lift housing 505, which is moved downward, upward.

The lift housing 505 is guided by the guide rods 504*a* of the support plates 504 to be moved upward and downward.

The lift housing 505 is no longer moved upward by the target block 402 which collides with the periphery of the target groove 601 of the rotary plate 600, and is moved downward by the pinion gear 502 which is rotated in engagement with the rack gear 404, which remains fixed.

The lift housing 505 presses the elastic spring 506 while being moved downward by the pinion gear 502.

The rotary plate 600 is rotatably provided on an upper portion of a front surface of the vertical guide unit 300 and includes a plurality of target grooves 601 formed on a front surface thereof. The plurality of target grooves 601 are formed to be annularly spaced a predetermined interval apart from each other to allow the target block 402 of the target unit 400 to enter therein.

The rotary plate 600 is rotatably operated by a stepping motor 606*a* fixedly provided to a back surface of the vertical guide unit 300.

The stepping motor 606*a* senses each of the plurality of prize holders 700 corresponding to a rotation angle thereof.

The target groove 601 is preferably recessed to have an arrow shape to correspond to a shape of the target block 402.

The stepping motor 606*a* is controlled by the button 200*a* to stop the rotary plate 600 at a predetermined angle.

The prize holders 700 are provided inside the housing 100 to be adjacent to each other based on the vertical guide unit 300, are moved in the forward and backward directions, and move prizes accommodated therein downward.

The prize holders 700 are formed in a pair to be adjacent to each other, and one or more prize holders 700 are preferably spaced a predetermined interval apart from each other in the vertical direction.

The prize holder 700 includes a support unit 701, a moving unit 702, and a driving unit 703. The support unit 701 is fixedly provided inside the housing 100. The moving unit 702 has a shape which is hollow and has upper and lower portions are open, is provided inside the support unit 701 so as to be moved forward and backward, and pushes a prize placed on the support unit 701. The driving unit 703 is provided on a back surface of the moving unit 702 and moves the moving unit 702 forward and backward.

The moving unit 702 is preferably formed to have a hollow square shape.

A front surface of the moving unit 702 is made of a transparent material so that the prize placed on the support unit 701 can be seen from the outside.

The front surface of the moving unit 702 is preferably detachable.

Through holes 701*a* are formed on an upper surface of the support unit 701 in a longitudinal direction thereof. A rack gear 701*b* is formed in the through hole 701*a*. A driving device 703 includes a motor 703*a* therein and a pinion gear 703*b* connected to the motor 703*a*. An outer surface of the pinion gear 703*b* is engaged with the rack gear 701*b*.

The pinion gear 703*b* is rotated by the motor 703*a*, and is moved over the rack gear 701*b* to move the driving unit 703 forward or backward.

The game vending machine according to the present invention configured as described above operates as follows.

In the following description, although the vertical guide unit 300, the target unit 400, and the driving unit 500 are exemplarily described as being provided on a lower portion of the rotary plate 600, positions of the vertical guide unit 300, the target unit 400, and the driving unit 500 may be freely selected around an edge of the rotary plate 600 by a user.

First, when a coin is inserted into the coin input slot 201 formed on the front surface of the opening and closing door 200, the rotary plate 600, which is rotatably provided on the front surface of the vertical guide unit 300, is rotated in a forward or reverse direction.

In this case, the rotary plate 600 continuously sense a plurality of different prize holders 700 while being rotated in a predetermined direction by the stepping motor 606*a*.

That is, the stepping motor 606*a* and the sensed prize holder 700 are continuously changed while a rotation angle of the stepping motor 606*a* is continuously changed.

Here, when the user presses the button 200*a* of the opening and closing door 200 after seeing the rotation angle of the rotary plate 600 with his or her naked eye, the stepping motor 606*a* is controlled so that the rotary plate 600 is stopped while the target unit 400 is moved upward over the vertical guide unit 300.

In this case, the rack gear 404 of the target unit 400 is engaged with the pinion gear 502 of the driving unit 500, which is rotated by the motor 501, and is moved upward. Accordingly, the rack gear 404 moves the lifting block 401 upward so that the lifting block 401 is guided by the guide rail 303 of the vertical guide unit 300 and is moved upward.

When the target block 402 moved by the lifting block 401 enters the target groove 601 of the rotary plate 600, the first sensing frame 403 formed on the lifting block 401 operates the first sensor 304 of the vertical guide unit 300 so that the first sensor 304 operates any one of the plurality of prize holders 700.

At the same time, the first sensor 304 changes a rotation direction of the pinion gear 502 to a reverse direction. Accordingly, the rack gear 404 engaged with the pinion gear 502 is moved downward to return the target unit 400 to its original position.

Here, the first sensing frame 403 of the target unit 400 is moved downward by the lifting block 401 to operate the second sensor 305 formed on a lower portion of the inner wall of the cover frame 301. In this case, the second sensor 305 controls a rotation operation of the pinion gear 502 to prevent the target unit 400 from being moved a predetermined distance or more downward.

Then, the prize holder 700 receives a signal of the first sensor 304 and rotates the motor 703*a* of the driving device 703. While the pinion gear 703*b* is rotated by the rotation of the motor 703*a*, the pinion gear 703*b* is operated to be engaged with the rack gear 701*b* to move the driving device 703 forward or backward.

The moving unit 702 fixed to a front surface of the driving device 703 pushes a prize placed on the support unit 701 forward. In this case, the prize is pushed by the moving unit 702 and is then moved downward at a front end of the support unit 701 through the prize outlet path 101 of the housing 100.

The prize moved downward through the prize outlet path 101 reaches the outlet port 202 of the opening and closing door 200.

Meanwhile, when the target block 402, which is moved upward and downward by the lifting block 401 of the target unit 400, does not enter the target grooves 601 of the rotary plate 600 and collides with the periphery of the target groove 601, the rack gear 404 is no longer moved upward and remains in that position.

In this case, the pinion gear 502 of the driving unit 500 continuously rotates in the same direction and is moved downward over the fixed rack gear 404 to move the lift housing 505 of the driving unit 500 downward.

The lift housing 505 is guided by the guide rods 504*a* of the support plates 504 and moves downward to press the elastic springs 506 provided on the support plates 504.

In this case, the second sensing frame 503 formed on one side surface of the lift housing 505 is separated from the third sensor 306 of the vertical guide unit 300. Accordingly, the third sensor 306 controls the pinion gear 502 to rotate the pinion gear 502 in the reverse direction.

That is, the lift housing 505 is pressed by the elastic spring 506, which is restored to its original state, and is moved upward, the rack gear 404 is moved downward by the pinion gear 502 which is rotated in the reverse direction, and the target block 402 is returned to its original position as the lifting block 401 of the target unit 400 is returned to its original position.

As described above, the target unit 400 is moved upward and downward along the vertical guide unit 300. The game vending machine having a structure in which the target block 402 of the target unit 400 enters the target grooves 601 to operate the prize holder 700 is provided by using a simple game method in which there is no concern about a sag of the prize holders 700 due to a weight of a prize since relatively heavy or light prizes are accommodated in the prize holders 700 which are formed to be separated from each other, a user may select and discharge a prize since different prizes are accommodated in the prize holders 700, the user may easily see the type of prize from the outside with his or her naked eye, and the target block 402 enters the target groove 601 of the rotary plate 600 whose rotation is stopped by the operation of the user. Thus, anyone may easily enjoy the game.

According to the present invention, a game vending machine can be provided by using a simple game method in which there is no concern about a sag of prize holders due to a weight of a prize since relatively heavy or light prizes are accommodated in prize holders, which are formed to be separated from each other, a user can select and discharge a prize since different prizes are accommodated in the prize holders, the user can easily see the type of prize from the outside with his or her naked eye, and a target block enters a target groove of a rotary plate whose rotation is stopped by the operation of the user. Thus, there is an advantage in that anyone can easily enjoy the game and it causes the game to be challenging.

While one embodiment of the game vending machine of the present invention has been illustrated and described above, the invention is not limited to the aforementioned specific exemplary embodiment. Those skilled in the art may variously modify the invention without departing from the gist of the invention claimed by the appended claims, and such modifications are within the scope of the claims.

What is claimed is:

1. A game vending machine comprising:

A hollow housing (100) including an open front surface and a prize outlet path (101) formed on a lower portion thereof to guide a discharge of a prize (G);

an opening and closing door (200) rotatably coupled to the front surface of the housing (100), configured to open and close the front surface of the housing (100), and having a coin input slot (201) and an outlet port (202) through which the prize is discharged, wherein the coin input slot (201) and the outlet port (202) are formed on a front surface of the opening and closing door (200);

a vertical guide unit (300) including a hollow cover frame (301) having an open front surface and attached to a back surface thereof, a through hole (302) corresponding to the cover frame (301) and formed on the front surface thereof, a guide rail (303) corresponding to the through hole (302) and formed on an inner wall of the cover frame (301), and a first sensor (304) configured to output a signal and formed at an upper portion of an inner wall thereof, wherein the vertical guide unit (300) is fixed to be in close contact with an inner wall of the housing (100);

a target unit (400) including a lifting block (401) slidably coupled to the guide rail (303), a target block (402) exposed to an outside of the through hole (302), and a first sensing frame (403) configured to be moved upward and downward by the lifting block (401) to operate the first sensor (304), wherein the target block (402) and the first sensing frame (403) are formed on a front surface of the lifting block (401);

a driving unit (500) provided on a back surface of the cover frame (301) to be moved upward and downward and configured to move the target unit (400) upward and downward;

a rotary plate (600) rotatably provided on an upper portion of the front surface of the vertical guide unit (300) and having a plurality of target grooves (601) formed on a front surface thereof, wherein the plurality of target grooves (601) are formed to be annularly spaced a predetermined interval apart from each other to allow the target block (402) of the target unit (400) to enter therein; and prize holders (700) provided inside the housing (100) to be adjacent to each other based on the vertical guide unit (300), moved in the forward and backward directions, and configured to move the prize (G) accommodated therein downward for dispensing according to the signal from the first sensor (304) when the first sensing frame (403) of the target unit (400) operates the first sensor (304).

2. The game vending machine of claim 1, wherein the cover frame (301) of the vertical guide unit (300) further includes a second sensor (305) configured to sense the first sensing frame (403) of the lifting block (401), which is moved downward, and to block the lifting block (401) from being moved a predetermined distance or more downward, wherein the second sensor (305) is formed on a lower portion of the inner wall of the cover frame (301).

3. The game vending machine of claim 1, wherein a third sensor (306) is formed on the back surface of the cover frame (301) to sense whether the target block (402) of the target unit (400) collides with a periphery of the target groove of the rotary plate (600), control the driving unit (500), and move the target unit (400) downward, and a second sensing frame (503) is further formed on one side surface of the driving unit (500) to be separated from the third sensor (306) and to operate the third sensor (306).

4. The game vending machine of claim 1, wherein the target unit (400) includes a rack gear (404) formed on a back surface of the lifting block (401) in a longitudinal direction thereof, the driving unit (500) includes a motor (501) therein, and a pinion gear (502), which is connected to the motor (501), has one side surface engaged with the rack gear (404), and moves the rack gear (404) upward and downward, is formed on an outer surface of the driving unit (500).

5. The game vending machine of claim 1, wherein the driving unit (500) includes:

a pair of support plates (504) fixed to upper and lower ends of the back surface of the cover frame (301) and including a pair of guide rods (504*a*) which protrude in directions toward each other;

a lift housing (505) provided between the support plates (504) and including the motor (501) formed therein and the pinion gear (502) connected to the motor (501) formed on one side surface thereof; and an elastic spring (506) provided between one of the support plates (504), which is provided on a lower portion, and the lift housing (505) and configured to press the lifting housing (505), which is moved downward, upward.

6. The game vending machine of claim 1, wherein the prize holder (700) includes:

a support unit (701) fixedly provided inside the housing (100);

a hollow moving unit (702) having a shape in which upper and lower portions thereof are open, provided inside the support unit (701) so as to be moved forward and backward, and configured to push the prize placed on the support unit (701); and a driving device (703) provided on a back surface of the moving unit (702) and configured to move the moving unit (702) forward and backward.

7. The game vending machine of claim 6, wherein a front surface of the moving unit (702) is made of a transparent material so that the prize placed on the support unit (701) is seen from the outside.

8. The game vending machine of claim 6, wherein the support unit (701) includes a through hole (701*a*) formed on an upper surface thereof in a longitudinal direction thereof, a rack gear (701*b*) is formed in the through hole (701*a*), the driving device (703) includes a motor (703*a*) therein and a pinion gear (703*b*) connected to the motor (703*a*), and an outer surface of the pinion gear (703*b*) is engaged with the rack gear (701*b*).

9. The game vending machine of claim 4, wherein the driving unit (500) includes:

a pair of support plates (504) fixed to upper and lower ends of the back surface of the cover frame (301) and including a pair of guide rods (504*a*) which protrude in directions toward each other;

a lift housing (505) provided between the support plates (504) and including the motor (501) formed therein and the pinion gear (502) connected to the motor (501) formed on one side surface thereof; and an elastic spring (506) provided between one of the support plates (504), which is provided on a lower portion, and the lift housing (505) and configured to press the lifting housing (505), which is moved downward, upward.

* * * * *